US009284713B2

(12) United States Patent
Kobayashi

(10) Patent No.: US 9,284,713 B2
(45) Date of Patent: Mar. 15, 2016

(54) BACKHOE BUCKET MOVEABLE THUMB ASSEMBLY AND METHOD

(76) Inventor: Herbert S. Kobayashi, Webster, TX (US)

( * ) Notice: Subject to any disclaimer, the term of this patent is extended or adjusted under 35 U.S.C. 154(b) by 951 days.

(21) Appl. No.: 13/172,085

(22) Filed: Jun. 29, 2011

(65) Prior Publication Data

US 2013/0000160 A1 Jan. 3, 2013

(51) Int. Cl.
*E02F 3/407* (2006.01)
*E02F 3/40* (2006.01)

(52) U.S. Cl.
CPC ..... *E02F 3/404* (2013.01); *Y10T 29/49826* (2015.01); *Y10T 29/49959* (2015.01)

(58) Field of Classification Search
USPC ..... 37/406, 445
See application file for complete search history.

(56) References Cited

U.S. PATENT DOCUMENTS

| | | | | | |
|---|---|---|---|---|---|
| 4,635,386 | A * | 1/1987 | Kobayasi | ..... | 37/406 |
| 4,907,356 | A * | 3/1990 | Labounty | ..... | 37/406 |
| 5,553,408 | A * | 9/1996 | Townsend | ..... | 37/406 |
| 5,678,332 | A * | 10/1997 | Hawkins | ..... | 37/403 |
| 6,088,938 | A * | 7/2000 | Logan | ..... | 37/468 |
| 6,154,989 | A * | 12/2000 | Kaczmarski et al. | ..... | 37/444 |
| 6,260,294 | B1 * | 7/2001 | Pitcher | ..... | 37/406 |
| 6,640,471 | B2 * | 11/2003 | Desrochers | ..... | 37/406 |
| 7,111,419 | B1 * | 9/2006 | Miller | ..... | 37/406 |
| 2006/0230646 | A1 * | 10/2006 | Schmidt et al. | ..... | 37/381 |
| 2008/0086920 | A1 * | 4/2008 | Lim | ..... | 37/406 |

* cited by examiner

*Primary Examiner* — Thomas Will
*Assistant Examiner* — Joan D Misa
(74) *Attorney, Agent, or Firm* — Kenneth L. Nash

(57) ABSTRACT

A closure member is pivotally connected with respect to a hydraulically operated bucket. A link member is pivotally connected to a hydraulically operated arm segment. The link member is also pivotally connected to the closure member. The closure member and the hydraulically operated bucket are connected for simultaneous pivotal movement in opposite directions with respect to each other.

16 Claims, 4 Drawing Sheets

BACKHOE BUCKET MOVEABLE THUMB ASSEMBLY AND METHOD

BACKGROUND OF THE INVENTION

1. Field of the Invention

The present invention relates generally to construction equipment such as backhoes and, more particularly, to a movable thumb or closure element, which operates in conjunction with a hydraulically controlled bucket. While the present invention is described in terms of a backhoe bucket, the present invention may be utilized with other construction equipment having a pivotally mounted bucket for operation on a hydraulic arm.

2. Description of the Prior Art

Most backhoes are equipped with a hydraulically pivotal bucket. If only the backhoe bucket is used, it is very difficult to pick up objects such as a tree because if the object or tree is not perfectly balanced on the bucket, then the object or tree will tend to fall off. As well, it may be difficult to grasp objects such as trees for lifting or pulling purposes.

Because of this problem, a fixed thumb or hydraulic control thumb may be attached for use with a bucket. As used herein a thumb is a closure element of some type against which the bucket may be rotated for grasping purposes. A movable thumb in accord with the present invention is discussed hereinafter.

The disadvantage of a fixed thumb or closure element is that the fixed thumb must be pushed against the object, such as a tree by lowering the lifting boom and moving the stick boom of the backhoe toward the object. Then the bucket is rotated against the thumb. Another problem with a fixed thumb is that the fixed thumb may interfere with other operations of the bucket. The fixed thumb does not permit wide range of different size objects to be manipulated. The fixed sum is also not in the right position to be of any use to pick up a pile of loose dirt or other material.

The prior art hydraulically operated movable thumb requires the movable thumb to be moved toward the object, whereupon the bucket is rotated against the thumb. This action requires the operator's use of multiple levers, which is slow and over time becomes tedious. The operation may also be complex. The hydraulically operated thumb and bucket operation may require the operator to use three levers simultaneously for grasping and lifting. The limited range of movement of the hydraulically operated thumb limits the variation in size of the objects, such as trees or poles, which can be manipulated by the backhoe.

The above cited prior art does not disclose a movable thumb that permits the operator to use a single lever to control pivotal motion of the backhoe bucket and the movable thumb simultaneously. The solutions to the above described and/or related problems have been long sought without success. Consequently, those skilled in the art will appreciate the present invention that addresses the above and other problems.

SUMMARY OF THE INVENTION

It is a general purpose of the present invention to provide an improved movable thumb assembly.

An object of the present invention is to provide a movable thumb assembly which operates in conjunction with a pivotal bucket.

An advantage of the present invention is that an operator can control both the bucket and the movable thumb utilizing only one hydraulic lever control.

A movable thumb assembly for use with a hydraulically operated bucket may comprise a first hydraulically operated arm segment, a second hydraulically operated arm segment connected to the first hydraulically operated arm segment, and a bucket pivot connection which pivotally connects the hydraulically operated bucket to the second hydraulically operated arm segment.

A moveable thumb, i.e., a closure member is pivotally connected with respect to the hydraulically operated bucket.

A link member is pivotally connected to the second hydraulically operated arm segment. The link member is also pivotally connected to the closure member. The closure member and the hydraulically operated bucket are connected for pivotal movement in opposite directions with respect to each other.

The movable thumb assembly may further comprise a bucket bracket mounted to the hydraulically operated bucket for providing the pivotal connection between the closure member and the hydraulically operated bucket.

In one embodiment, the bucket bracket may preferably be positioned adjacent to or in the vicinity of the bucket pivot connection.

The movable thumb assembly may further comprise a first link member pivotal connection for providing that the link member is pivotally connected to the second hydraulically operated arm segment, a second link member pivotal connection for providing that the link member is pivotally connected to the closure member, and a closure member pivotal connection for providing that the closure member is pivotally connected with respect to the hydraulically operated bucket.

In one embodiment, the first link member pivotal connection, the second link member pivotal connection, and the closure member pivotal connection each comprise removable pins, whereby the link member and the closure member are removable from the hydraulically operated bucket.

In one embodiment, the closure member comprises a closure member axial shaft portion. In this embodiment, the bucket bracket is pivotally connected to the shaft.

The second link member pivotal connection may be positioned further from the bucket pivot connection along the closure member axial shaft than the bucket bracket.

In one embodiment, the closure member comprises a length which is approximately equal to a length of an open end of the hydraulically operated bucket. However, the closure member could be longer or shorter than the open end of the hydraulically operated bucket.

In one embodiment, the closure member and the link member are mounted with removable pins, which have fasteners, latches, or fastening mechanisms to keep them in position during operation. By removing the removable pins, the closure member and the link member are removable from the hydraulically operated bucket.

In another embodiment, the present invention provides a method for mounting a movable thumb assembly for use with a hydraulically operated bucket.

The method may comprise steps such as pivotally connecting a closure member with respect to the hydraulically operated bucket, pivotally connecting a first portion of a link member to the second hydraulically operated arm segment, and pivotally connecting a second portion the link member to the closure member whereby the closure member and the hydraulically operated bucket are connected to pivot in opposite directions with respect to each other.

The method may further comprise mounting a bucket bracket to the hydraulically operated bucket for providing the pivotal connection between the closure member and the hydraulically operated bucket.

The method may further comprise mounting the bucket bracket adjacent to the bucket pivot connection.

The method may further comprise steps such as providing a first link member pivotal connection for implementing that the link member is pivotally connected to the second hydraulically operated arm segment, providing a second link member pivotal connection for implementing that the link member is pivotally connected to the closure member, and providing a closure member pivotal connection for implementing that the closure member is pivotally connected with respect to the hydraulically operated bucket.

In one embodiment the method may comprise providing that the first link member pivotal connection, the second link member pivotal connection, and the closure member pivotal connection each comprise removable pins, whereby the link member and the closure member are removable from the hydraulically operated bucket.

In one embodiment, the method may further comprise providing that the closure member comprises a closure member axial shaft and providing that the second link member pivotal connection is positioned further from the bucket pivot connection along the closure member axial shaft than the bucket bracket. In this embodiment, the method may comprise providing that the bucket bracket is pivotally connected to the closure member axial shaft.

The method may comprise providing that the closure member comprises a length which is approximately equal to a length of an open end of the hydraulically operated bucket.

The method may comprise mounting the closure member and the link member utilizing removable pins, whereby the closure member and the link member are removable from the hydraulically operated bucket.

In another embodiment, the movable thumb assembly may comprise a bucket bracket mounted to the hydraulically operated bucket, a closure member pivotally connected to the bucket bracket, and a link member.

A link member first pivotal connection pivotally connects the link member to the second hydraulically operated arm segment. A link member second pivotal connection pivotally connects the link member to the closure member.

In this embodiment, the bucket bracket is positioned closer to the bucket pivot connection then the link member second pivotal connection.

In this embodiment, the link member first pivotal connection is positioned on or adjacent to one end portion of the link member and the link member second pivotal connection is positioned on an opposite end portion of the link member.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like reference numerals refer to like parts and wherein.

DESCRIPTION OF THE PREFERRED EMBODIMENT

The presently described backhoe with movable thumb provides a simplified grasping action, which operates more quickly and effectively than prior art backhoes.

Figure 1:
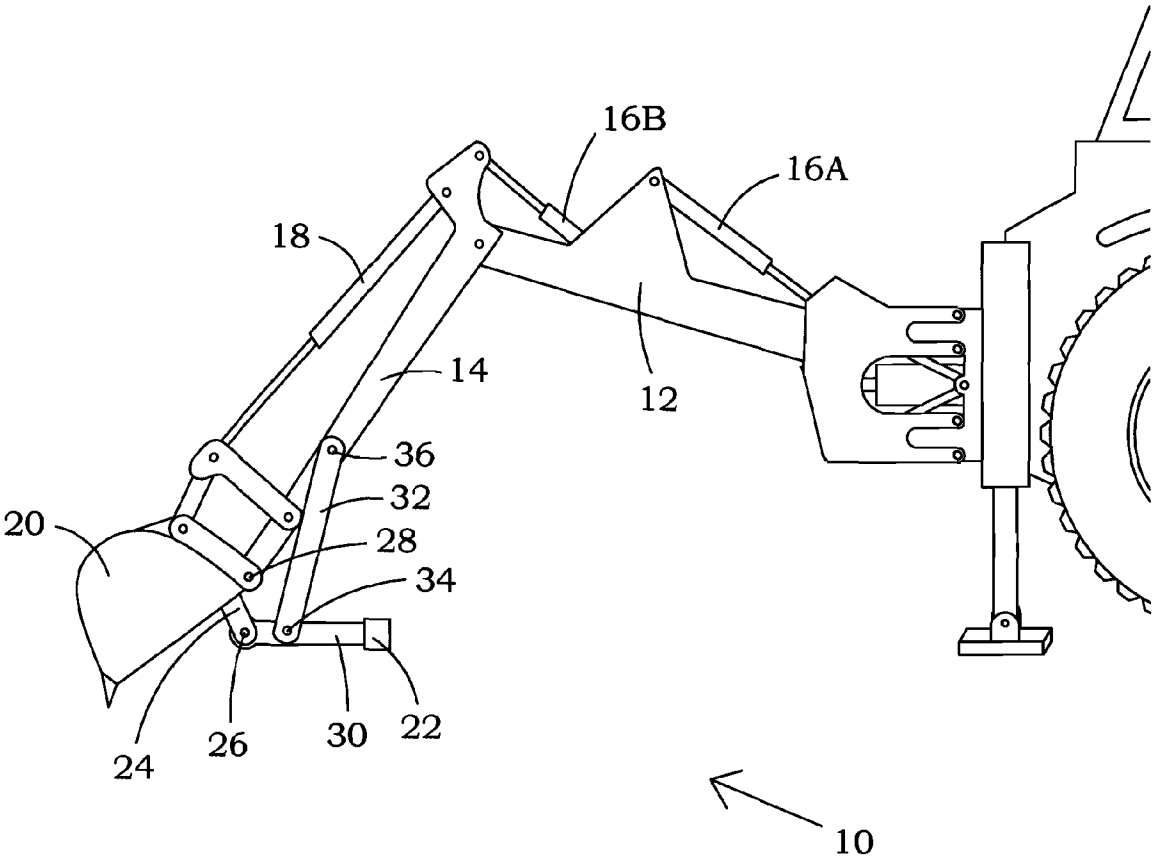
FIG. 1 is a side elevational view of a backhoe with the moveable thumb and bucket in an open position, in accord with one possible embodiment of the present invention.
Figure 2:
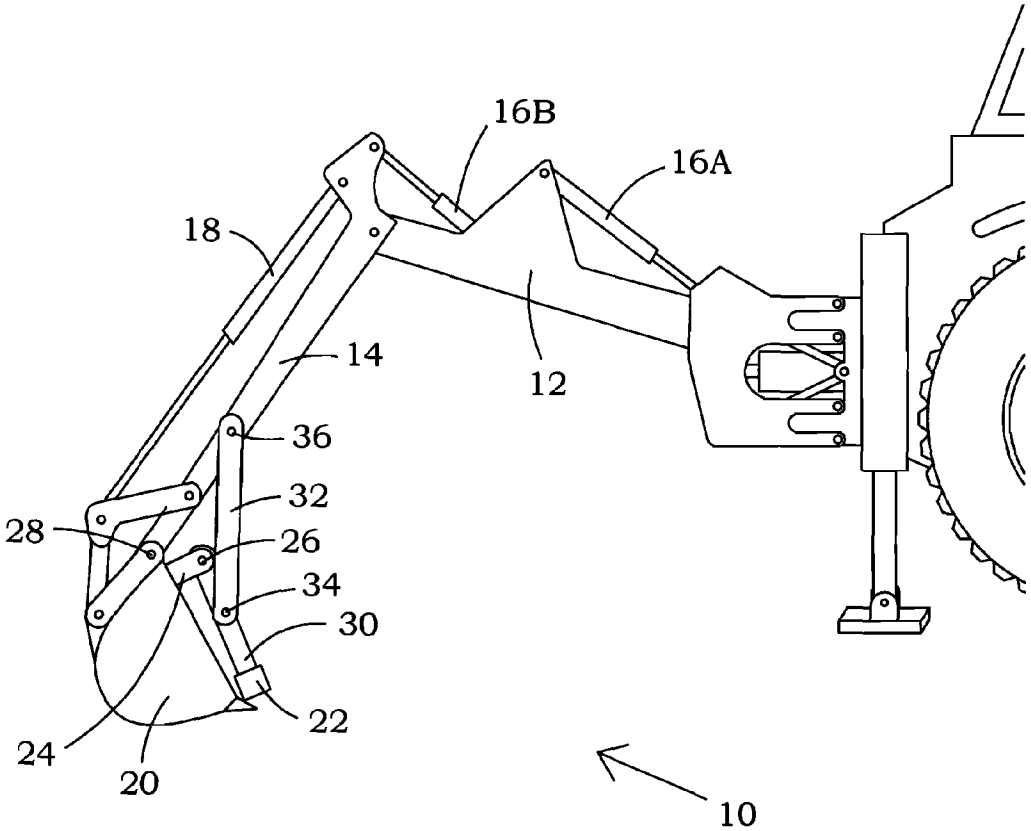
FIG. 2 is a side elevational view of a backhoe with the moveable thumb and bucket in a closed position, in accord with one possible embodiment of the present invention.

FIG. 1 and FIG. 2 show a generalized backhoe arm and backhoe bucket to which movable thumb mechanism 10 may be detachable you mounted. It will be appreciated that the present invention may be utilized with other construction equipment, which comprises a pivotally mounted bucket for use on a hydraulic arm.

The backhoe arm may typically comprise components such as lift boom 12, stick boom 14, hydraulic cylinders 16A and 16B, and hydraulic cylinder 18. These components may be utilized to operate a backhoe bucket 20 by positioning backhoe bucket 20 where needed and moving backhoe bucket 20 as desired.

In FIG. 1, backhoe bucket 20 and movable thumb 22 are in the open or dumping position. Accordingly, thumb 22 rotates away from the open end of bucket 20 towards the backhoe arm.

In FIG. 2, movable thumb 22 and backhoe bucket 20 are rotated relative to each other to close the gap there between, which enables dirt to be pushed into the bucket or enables clamping onto a tree or other object.

Movable thumb mechanism 10 may be permanently mounted or may be removable as desired. In this embodiment, movable thumb mechanism is pin mounted so as to be easily removable, as discussed in more detail hereinafter.

Figure 3:
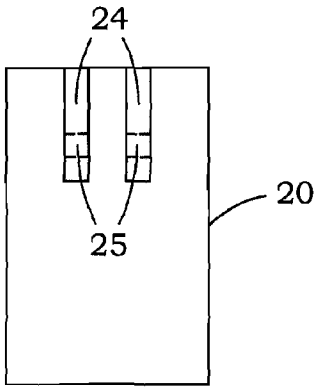
FIG. 3 is a top elevational view, partially in hidden lines, which shows a bucket bracket mounted to the backhoe bucket, in accord with one possible embodiment of the present invention.

Bucket bracket 24 may in one embodiment be fixed to bucket 20 whereupon bucket bracket 24 rotates with bucket 20, as controlled by the operator utilizing a single hydraulic control. Bucket bracket 24 may preferably mounted near a hinge such as hinge 28 upon which bucket 20 rotates. The purpose of bucket bracket 24 is to provide a hinge for pivotally mounting arm 30 of movable thumb 22. In one embodiment, bucket bracket 24 may comprise two rectangular elements welded to one side of bucket 20 as shown in FIG. 3. Holes 25 may be utilized for insertion of hinge pin 26.

Bucket bracket 24 may be welded to backhoe bucket 20. In another possible embodiment, bucket bracket 24 may be removable and comprise an arm which is inserted into a socket and pinned into position so as to be removable if desired. As noted above, bucket bracket 24 provides a hinge or pivot for arm 30 of movable thumb 22. In this case, the hinge may utilize removable pin 26 to permit removal of movable thumb 22. The hinge or pin 26 may be provided closer to or further away from the edge of the open end of bucket 20, as desired.

In this embodiment, bucket bracket 24 is positioned near the side of the bucket closest to the backhoe arm which avoids interference with operation of bucket 20 during digging or the like. Bucket bracket 24 may also extend away from the open side of bucket 20. However, hinge 26 provided by bucket bracket 24 could also be located somewhat within the interior of bucket 20 but is then preferably near the bucket hinge 28.

At least one link member 32 is pivotally or pin mounted to backhoe stick 14 on one end or end portion, and is also pin mounted to arm 30 of movable thumb 22 on the opposite end or end portion. Holes 35 and 37, as shown in FIG. 5A and FIG. 5B, may be utilized for respective pin members 34 and 36.

Pins 26, 34, and 36 may be removable pins. The pins may have holes in one end, which are held or latched in place by Cotter pins or other clips, pins, latches, or the like, which prevent pins 26, 34, and 36 from unintentional removal. Because pins 26, 34, and 36 are removable, link member 32 and movable thumb 22 are readily removable from bucket 20.

Figure 5A:
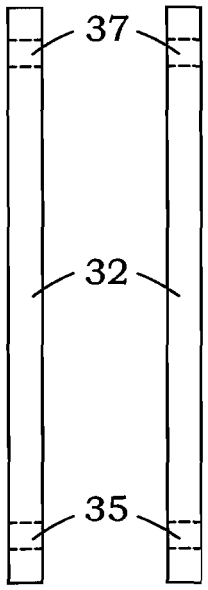
FIG. 5A is a top elevational view, partially in hidden lines, which shows two link members that pivotally connect the backhoe arm to the movable thumb, in accord with one possible embodiment of the present invention.
Figure 5B:
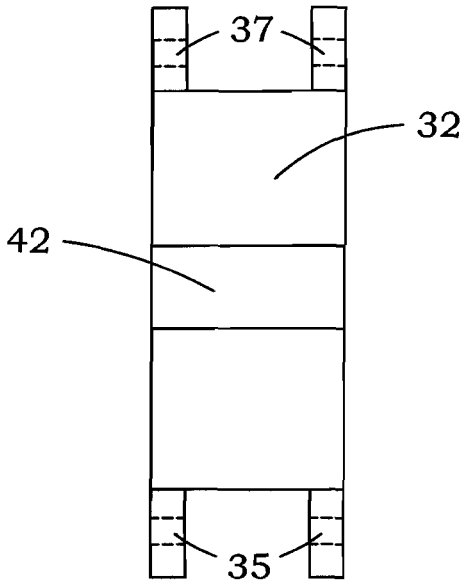
FIG. 5B is a top elevational view, partially in hidden lines, which shows a single link member that pivotally connects the backhoe arm to the movable thumb, in accord with one possible embodiment of the present invention.

FIG. 5A and FIG. 5B show different embodiments of a link member, which connects between is stick boom 14 and arm 30 of movable thumb 22. If desired, length adjust segments, such as length adjust segment 42, may be added to or removed from link member 32 to vary the closure distance between movable thumb 22 and bucket 20. For example, it may be desired to have an offset of a few inches between the rim of bucket 20 and movable thumb 22 when these components are rotated to the closed position. Alternatively, it may be desired that movable thumb 22 engage or almost engage bucket 20.

Movable thumb 22 may be referred to herein as a movable closure element, movable lid, hinged flap, or the like. Movable thumb 22 may take various shapes as desired.

It will be appreciated that the pins, fasteners, and the like for the elements of bucket bracket 24, movable thumb 22, in link members 32 discussed above may be provided in various ways, positions, and arrangements. For example, there are many ways that link members 32 may be pivotally attached to backhoe stick 14. Pins could be welded to backhoe stick 14 for connection to link members 32. A single pin may connect both laying members 32 to backhoe stick 14. Alternatively, a bracket (not shown) may be mounted to backhoe stick 14 and utilized to pivotally connect to link members 32.

Link member(s) 32 may be relatively straight as shown but could also be bent, curved, angled, or the like as needed, desired, are most convenient for proper opening and closing movable thumb 22 with respect to bucket 20.

It will be appreciated that the length of link members 32, and position of hinges 26 and 34 on movable thumb 22, as well as the position and length of bucket bracket 24 will determine the opening and closing positions of movable thumb 22 with respect to bucket 20. As discussed above, an offset between movable thumb 22 and bucket 20 in a closed position can be adjustable utilizing adjustment sections, if desired.

Figure 4:
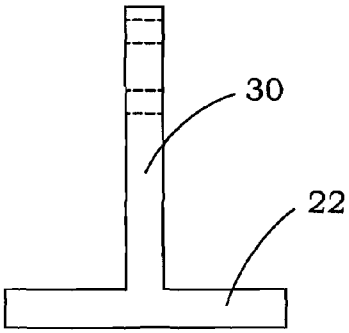
FIG. 4 is a top elevational view, partially in hidden lines, which shows a movable thumb, in accord with one possible embodiment of the present invention.

FIG. 4 shows one possible embodiment for movable thumb 22. Many possible variations may be utilized. For example, movable thumb 22 may comprise a flap hinged to bucket 20, which may completely or almost completely covers the opening of bucket 20. In one embodiment, bucket bracket 24 may be positioned on the sides of bucket 20 to provide a hinge for the flap. In this embodiment, link member 32 is modified accordingly to pivotally engage and pivotally connect to a wider flap. Movable thumb 22 might also comprise a screen or the like. In any case, it will be understood that movable thumb 22 may be of various shapes and designs. However, in accord with the present invention, bucket 20 and a movable thumb 22 moves in concert with each other for opening and closing.

Referring to FIG. 1, during operation, if bucket 20 is rotated clockwise as controlled by hydraulic cylinder 18, then movable thumb 22 rotates counterclockwise relative to bucket 20. This is because link member 32 pulls movable thumb in this direction in response to clockwise rotation of bucket 20. Movable thumb 22 is constrained to rotate around pivot 26.

Referring to FIG. 2, if bucket 20 is rotated counterclockwise by hydraulic cylinder 18, then movable thumb 22 is rotated clockwise. Because one hydraulic cylinder controls rotational movement of both bucket 20 and movable thumb 22, it is very easy for an operator to control both of these functions quickly and conveniently as compared to the prior art hydraulic movable thumb.

The invention does not require another control lever to operate the movable thumb assembly nor does it require operation of three levels almost at the same time to push the dirt or object in order to perform the task. In this way, the results of the job can be performed better and faster. By utilizing only one hydraulic control lever to operate bucket 20 and movable thumb assembly 10, the operator has more precise control, gets the job completed faster, more simply, and provide easier and more accurate placement of material. Also, the gap between the thumb and the bucket is greater when in the open position to allow handling of bigger objects.

Many additional changes in the details, components, steps, and organization of the system, herein described and illustrated to explain the nature of the invention, may be made by those skilled in the art within the principle and scope of the invention. It is therefore understood that within the scope of the appended claims, the invention may be practiced otherwise pulls as specifically described.

What is claimed is:

1. A movable thumb assembly for use with a hydraulically operated bucket, comprising:

a first hydraulically operated arm segment;

a second hydraulically operated arm segment connected to said first hydraulically operated arm segment;

a bucket pivot connection, which pivotally connects said hydraulically operated bucket to said second hydraulically operated arm segment;

a closure member;

a bucket bracket affixed to an inside surface of said hydraulically operated bucket for providing a bucket bracket pivotal connection between said closure member and said hydraulically operated bucket, said closure member being pivotally connected to said bucket bracket; and a link member pivotally connected to said second hydraulically operated arm segment, said link member also being pivotally connected to said closure member, whereby said closure member and said hydraulically operated bucket are connected for pivotal movement in opposite directions with respect to each other.

2. The movable thumb assembly of claim 1, wherein said closure member comprises a relatively straight elongated member sized to cover an open end of said hydraulically operated bucket.

3. The movable thumb assembly of claim 2, wherein said link member comprises two arms which fit on two sides of said elongated member.

4. The movable thumb assembly of claim 1, further comprising a link member-closure member pivotal connection to provide said pivotal connection between said link member and said closure member, wherein said bucket bracket pivotal connection is located closer to said bucket pivot connection than said link member-closure member pivotal connection.

5. The movable thumb assembly of claim 1, wherein said link member comprises a plurality of length adjust segments, whereby said plurality of length adjust segments may be added to or removed from said link member to vary a closure offset distance between said hydraulically operated bucket and said closure member.

6. The movable thumb assembly of claim 5, wherein said length adjust segments may be selectable to provide an adjustable offset between said closure member and said hydraulically operated bucket in a closed position.

7. A method for mounting a movable thumb assembly for use with a hydraulically operated bucket, a first hydraulically operated arm segment, a second hydraulically operated arm segment connected to said first hydraulically operated arm segment, a bucket pivot connection which pivotally connects said hydraulically operated bucket to said second hydraulically operated arm segment, said method comprising:

mounting a bucket bracket to an inside surface of said hydraulically operated bucket for providing a bucket bracket pivotal connection between a closure member and said hydraulically operated bucket;

pivotally connecting said closure member to said bucket bracket;

pivotally connecting a first portion of a link member to said second hydraulically operated arm segment; and pivotally connecting a second portion of said link member to said closure member whereby said closure member and said hydraulically operated bucket are connected to pivot in opposite directions with respect to each other.

8. The method of claim 7, providing that said closure member comprises a relatively straight elongated member sized to cover an open end of said hydraulically operated bucket.

9. The method of claim 7, further comprising providing that said bucket bracket pivotal connection is positioned within the interior of said bucket.

10. The method of claim 7, further comprising providing that said link member comprises two arms which fit on two sides of said closure member.

11. The method of claim 7, further comprising providing that said bucket bracket pivotal connection is located closer to said bucket pivot connection than a pivotal connection between said link member and said closure member.

12. The method of claim 7, further comprising providing a plurality of length adjust segments, whereby said plurality of length adjust segments may be added or removed from said link member to vary a closure distance between said hydraulically operated bucket and said closure member.

13. The method of claim 12, comprising providing that said length adjust segments may be selectable such that said closure distance provides an adjustable offset between said closure member and said hydraulically operated bucket in a closed position.

14. A movable thumb assembly for use with a hydraulically operated bucket, comprising:

a first hydraulically operated arm segment;

a second hydraulically operated arm segment connected to said first hydraulically operated arm segment;

a bucket pivot connection which pivotally connects said hydraulically operated bucket to said second hydraulically operated arm segment;

a bucket bracket mounted to an inside surface of said hydraulically operated bucket;

a closure member pivotally connected to said bucket bracket;

a link member;

a link member first pivotal connection which pivotally connects said link member to said second hydraulically operated arm segment;

a link member second pivotal connection which pivotally connects said link member to said closure member.

15. The movable thumb assembly of claim 14, wherein said bucket bracket is positioned closer to said bucket pivot connection than said link member second pivotal connection.

16. The movable thumb assembly of claim 14, wherein said link member first pivotal connection is positioned on one end of said link member and said link member second pivotal connection is positioned on an opposite end of said link member.

* * * * *